United States Patent [19]

Schuman

[11] 3,968,482

[45] July 6, 1976

[54] PRESSURE MODULATED ALARM SYSTEM

[76] Inventor: Mark Schuman, 101 G St. Southwest, Washington, D.C. 20024

[22] Filed: Nov. 16, 1973

[21] Appl. No.: 416,511

Related U.S. Application Data

[63] Continuation-in-part of Ser. No. 360,049, May 14, 1973, abandoned, which is a continuation-in-part of Ser. No. 213,994, Dec. 30, 1971, abandoned, which is a continuation-in-part of Ser. No. 141,171, May 7, 1971, abandoned.

[52] U.S. Cl. ..... 340/240; 109/39; 340/236

[51] Int. Cl.[2] ..... G08B 21/00

[58] Field of Search ..... 340/240, 258 B, 258 C, 340/261, 276, 236, 239 R, 229, 258 R, 258 A; 109/31–44; 98/1.5; 52/2; 116/65; 137/557; 73/49.2

[56] References Cited

UNITED STATES PATENTS 3,513,463 5/1970 Stevenson, Jr. et al. ..... 340/258 R

*Primary Examiner*—John W. Caldwell
*Assistant Examiner*—Daniel Myer
*Attorney, Agent, or Firm*—Wigman & Cohen

[57] ABSTRACT

A monitoring system for detecting changes in the fluidic impedance or volume of the boundary or bounded regions of an enclosure, including detecting entry into, as well as certain movements within, a substantially sealed enclosure by means of non-synchronous or synchronous detection of a modulated pressure induced within the enclosure. The air pressure within the enclosure is modulated at a predetermined amplitude and frequency, and means tuned that that frequency produce electrical signals indicative of the amplitude and possibly phase, whereby entry into the enclosure, blockage or unblockage of passageways within the enclosure, or movement of certain objects within the enclosure vary the amplitude and/or phase of the modulated pressure in one or more bounded regions of the enclosure, thereby causing the electrical signal or signals to vary sufficiently to actuate an alarm. The means which produce the electrical signals may include sensor means constructed to cooperate with boundary regions of the enclosure to provide a chamber normally substantially closed with respect to the enclosure in which pressure variations are adapted to be induced, whereby movement of the sensor means away from the cooperating boundary region will open the normally closed chamber to the induced pressure variation thereby actuating the alarm. The sensor means, which may be part of a portable sensor-transmitter unit, may alternatively be located within furniture constructed to form such a normally closed chamber, whereby movement or opening of the furniture causes an alarm to be transmitted. A motor driven reversible pitch fan and a motor driven oscillating door are alternative means disclosed for inducing inverse pressure variations on opposite sides of an internal wall to facilitate cancellation of spurious pneumatic effects such as wind while providing the predetermined pressure modulation.

54 Claims, 8 Drawing Figures

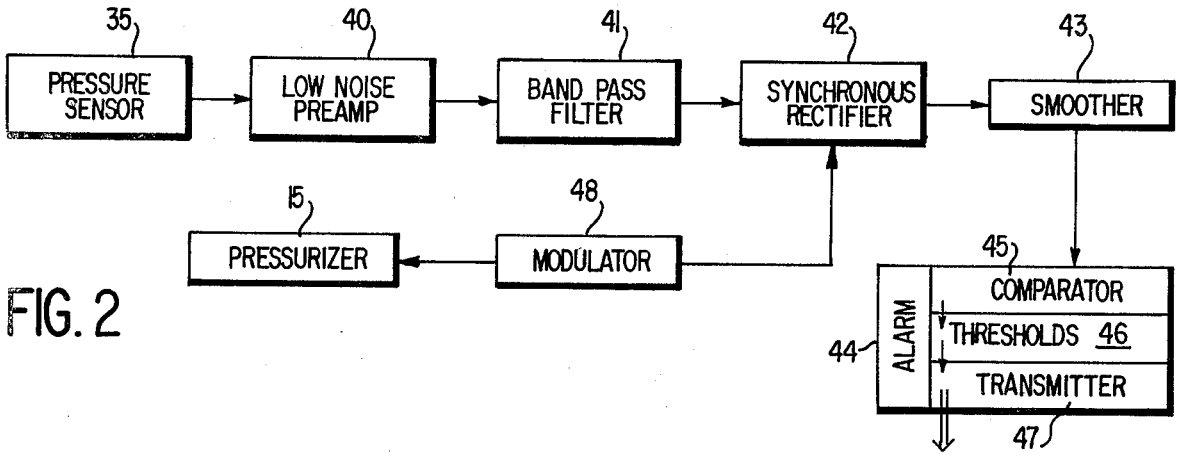
FIG. 2
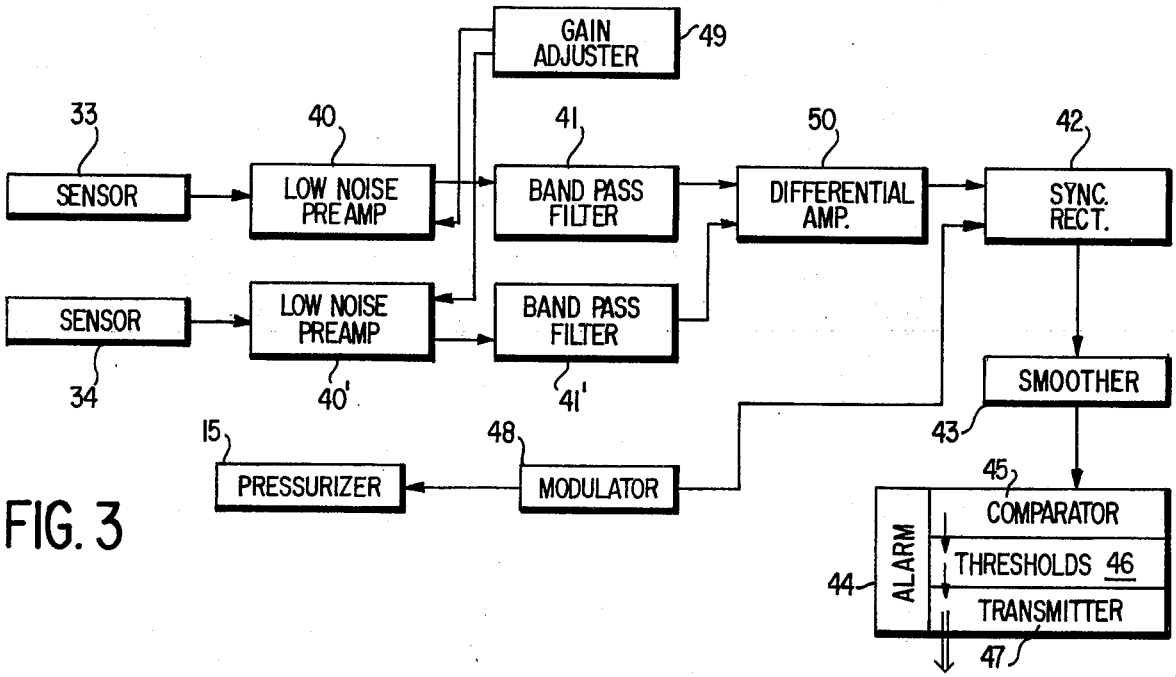
FIG. 3
FIG. 4
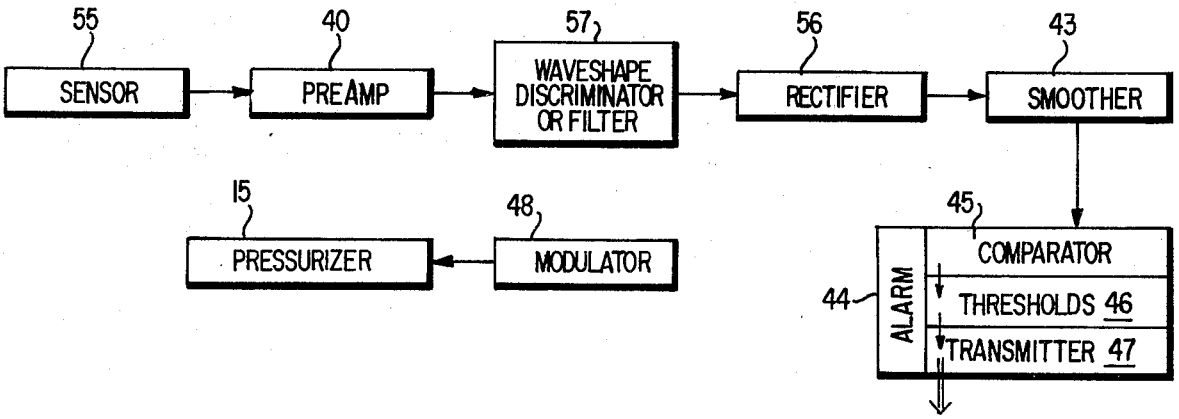

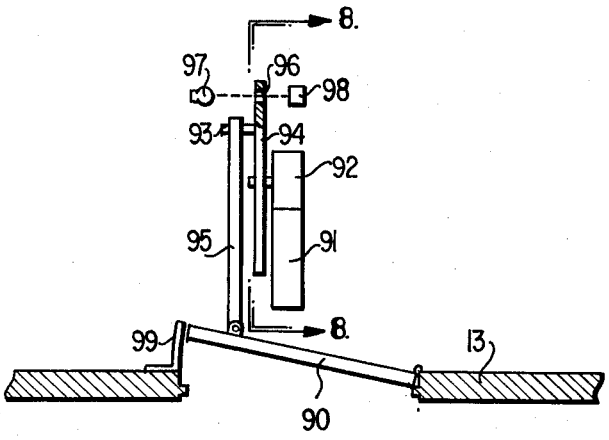
FIG. 7
FIG. 8
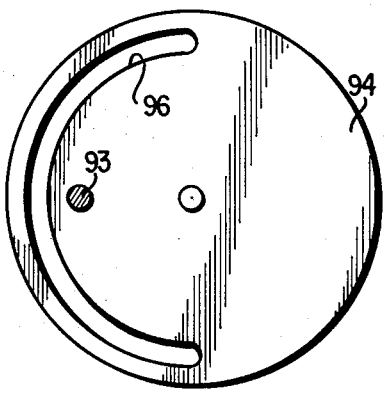
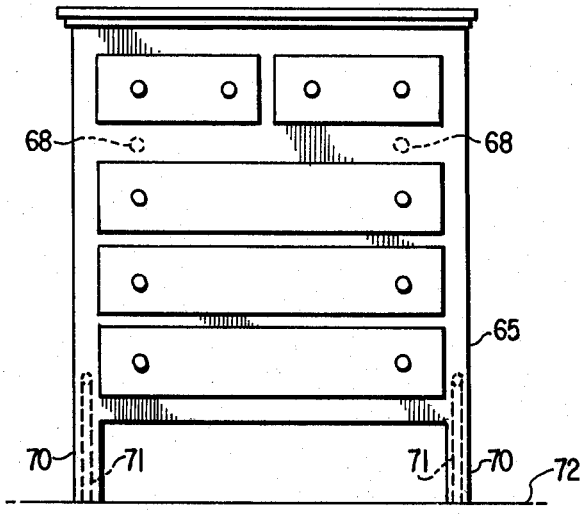
FIG. 6

PRESSURE MODULATED ALARM SYSTEM

This application is a continuation-in-part of copending application Ser. No. 360,049 filed May 14, 1973, which was a continuation-in-part of application Ser. No. 213,994 filed Dec. 30, 1971, which in turn was a continuation-in-part of application Ser. No. 141,171, filed May 7, 1971, all now abandoned.

This invention relates generally to the art of security systems, and more particularly to an alarm system for detecting entry into an enclosure, blockage or unblockage of a passageway within the enclosure, or opening of a substantially closed chamber within the enclosure, by means of producing and monitoring a modulated pressure signal within the enclosure.

In copending application Ser. No. 360,049, now abandoned, there is disclosed a monitoring system for detecting certain changes in the geometry of an enclosure such as changes in the volume or pneumatic impedance of an enclosure or of a bounded region of an enclosure which could occur, for example, upon a break, opening, closing, stretching, compression, expansion or other movement of or addition to a boundary region of the enclosure, including certain movements of persons or objects within the enclosure. A bounded region is a region of relatively low and uniform pneumatic impedance bounded by at least one boundary region having higher impedance. Thus, one or more communicating rooms or chambers may form a bounded region having a relatively uniform pressure at most any instant in time. The walls of the rooms or chambers, as well as objects and persons within the rooms, are of higher pneumatic impedance, are capable of supporting a substantial pressure gradient or differential pressure, and function as boundary regions bounding and defining the bounding region which they, as a group, enclose or define.

The aforementioned copending application discloses a monitoring system which includes a fan or other type blower mounted in a port formed in a wall or other boundary region of the enclosure intended to be protected which may be turned on and off or reversed at periodic intervals to create a cyclical pressure variation in one or more bounded regions or chambers of the enclosure. The modulated pressure in a bounded region can be monitored by a conventional pressure sensor such as a diaphragm type sensor or a piezoelectric crystal, and an electric current is generated. Alternatively, differential pressure across a boundary region may be sensed. The output of the sensor or transducer may first be amplified and then fed to a bandpass filter so as to amplify the modulated pressure signal at the modulation frequency, while attenuating and discriminating against spurious signals at other frequencies. The electrical bandpass can be further narrowed, i.e., the tuning made sharper, to further discriminate against spurious effects at other frequencies and phases, by feeding the signal, after any such electrical amplification and filtering, into a synchronous rectifier where it is switched in polarity twice a cycle at the proper frequency and phase, corresponding mainly to the frequency and phase of the pressure modulation, and perhaps corresponding slightly to the location of the sensor, so that a raw D.C. signal is produced having an average D.C. amplitude that is proportional to the amplitude of the modulated pressure or differential pressure at the given phase. This raw D.C. signal is then smoothed by means of an RC filter, thereby further narrowing the effective electrical bandwidth, and further increasing the discrimination against spurious signals, at frequencies and phases other than the modulation frequency and phase, which tend to cause false alarms. Entry into the enclosure causing a pneumatic leak sufficient to vary the snychronously rectified average D.C. signal a predetermined amount will actuate the alarm as will certain movements of or within the enclosure which cause a change in pneumatic impedance or volume of the enclosure or of a bounded or boundary region of the enclosure.

To measure differential pressure between two chambers or bounded regions of an enclosure, in order to still further cancel spurious pneumatic effects such as pressure effects from gusting wind which tend to affect both chambers similarly, a modulated differential pressure is induced between the two chambers, a sensor may be located in each chamber and their difference signal, after filtering, amplification, synchronous rectification, and smoothing may be utilized to trigger the alarm upon a sufficient deviation of the signal (and the modulated differential pressure) from its predetermined amplitude and/or phase, as described above. The subtraction process to obtain the difference signal can be made at any stage of the signal processing. The spurious effects are thereby cancelled to the extent that the two chambers are equally vented or exposed to the wind or other pneumatic noise source, i.e., to the extent that they are equally affected by the spurious source. Alternatively, the alternating pressure differential pressure signal might be monitored without amplification, filtering, and/or without synchronous rectification. Also, a single differential pressure sensor may alternatively be used to monitor the induced modulated differential pressure. In addition, integration or smoothing techniques other than by means of an RC filter may be used. Also, instead of taking the real time difference between pressure variations in two bounded regions, various alternative means of comparison may be used, such as difference strictly in amplitude or phase; ratio; and difference in time derivative or slope.

Further, the pressure modulation is not necessarily sinusoidal or periodic or even cyclical. For example, the pressure modulation can be a triangular, square, or exponential wave, or a periodic pulse, or a random pulse, and thus may contain more than one characteristic frequency. In any case, electronic means such as filtering may be used to tune the monitoring means to the characteristics of the induced pressure variation. Various pattern recognition techniques are known in the art for providing selective detection. As just one example, synchronous detection, e.g., synchronous rectification, can be used to sharpen the tuning and obtain greater sensitivity if desired. Such a system of synchronous rectification is disclosed in U.S. Pat. No. 2,451,572, issued Oct. 19, 1948 to H. R. Moore.

The technique of modulating and monitoring the pressure at a given frequency and perhaps phase, by reducing the effect on the detection signal of spurious pressure effects at frequencies or phases other than that of the modulator, including spurious effects at or near D.C., typically allows the use of a much smaller differential pressure and a much smaller fan or other modulator for a given sensitivity and false alarm rate, than do the previously used pneumatic detection techniques wherein a constant, rather than modulated, differential pressure was induced and monitored. The resulting decrease in fan power required, and correspondingly decreased thermal loss from the enclosure, makes the modulated pneumatic techniques more feasible and practical than the D.C. modulated systems. In many cases, an existing heating, air conditioning, or ventilating fan could be modified if desired to produce the small pressure variation required by the modulated system. The fan power can be modulated, or a port or duct can be alternatively blocked or otherwise modulated by valve means or vane means.

Instead of turning the fan on and off at periodic intervals, the cyclical pressure variation may be effected by periodically reversing the direction of the air flow, thereby inducing inverse pressure variations on opposite sides of a boundary region of an enclosure and maintaining an average ambient pressure condition within the region of the enclosure, thereby avoiding excessive heat transport through the boundary of the enclosure which will increase heating and air conditioning requirements. Or if a positive pressure system is needed simultaneously to provide forced fresh air to an enclosure, the rate of air flow may be cyclically varied to provide a modulated positive pressure in a bounded region of the enclosure. The direction of air flow from the fan may be reversed or the rate of air flow varied by any number of means well known in the art; for example, by changing the direction or the pitch of the fan blades or by providing valving means to alternately direct the air flow into and then out of the enclosure. If the fan speed and/or direction of rotation of the blades is to be varied, i.e., clockwise and counter-clockwise, the use of a low inertia rotor and blades increases the feasible modulation frequency. Nevertheless, if the fan speed and/or direction of rotation is to be modulated, it appears that because of the inertia of the blades, the optimum modulation frequency of such a modulator for protecting from one up to a few ordinary size rooms would be no greater than a few tenths of one Hertz and in certain cases could be considerably less than that. On the other hand, the pitch reversal or pitch variation technique and the valving technique could each be operated at much higher modulation frequencies if desired. Another method of modulating pressure with a fan is to rotate or oscillate the axis of a fan, similarly to the commercially available oscillating type fan. Thus, the axis of rotation of the fan could either be oscillated back and forth or continuously rotated to conduct gas in an oscillatory manner through a port or ports in a boundary of an enclosure.

Also disclosed in the aforementioned copending application Ser. No. 360,049 is the concept of placing a sensor within a specified substantially closed chamber located within or adjoining the pressurized enclosure, e.g., a hollow ceiling, double wall, attic, drawer, safe or room, the opening (or closing) of which may be detected by the relatively large increase (or decrease) in the modulated pressure in the chamber. Because of the large signal when, for example, a normally closed chamber is opened to pressurization, a sensor unit located in the chamber and tuned to the wave shape or characteristic frequencies of the modulator generally would not need synchronous rectification and could be portable, battery operated, would not have to be wired to the pressure modulator, and could transmit a pressure variation or pressure deviation indicating signal or an alarm signal. Thus, the monitoring means may include or even consist of, one or more remote, portable, sensor-transmitter units which may be part of a partially or completely wireless system. The sensor or sensors of such a remote, portable, sensor-transmitter unit may alternatively monitor differential pressure across a boundary region, or otherwise compare pressures in two bounded regions, or at any two locations at least one of which is located within the enclosure.

The alarm or indicating signal could be transmitted into the air and/or to a central unit or station by conventional means for transmitting signals, e.g., pneumatic waves such as sound; electro-magnetic radiation such as radio waves; or electric current in wires. For transmitting radio type waves, a transmitting coil or dipole or other antenna could be used. For transmitting pneumatic waves, an electric coil driven diaphragm or a piezoelectric transmitter might be used.

For transmitting a pressure-variation-indicating signal, such a transmitter could be responsive, for example, to the sensor output after one or more of filtering, amplifying, rectifying, and smoothing. For transmitting a pressure-deviation-indicating signal, such a transmitter could be responsive to the output of a voltage comparator which in turn is responsive to the sensor output after one or more of filtering, amplifying, rectifying, and smoothing. For transmitting an alarm signal, such a transmitter could be driven or activated by the outputs of one or more threshold circuits responsive to the output of the comparator. A conventional hold circuit can also be used to hold the alarm signal in an "on" condition to continue the transmission of an alarm signal for a given time interval, or until the system is reset in some prescribed manner. This could be done, for example, by designing the threshold circuits to stay on upon activation for a fixed time interval, or until reset.

If synchronous rectification is not used, a non-synchronous rectifier such as a half-wave or a full-wave rectifier, may be substituted for the synchronous rectifier and for the conduit providing the frequency and phase information to the rectifier from the pressure modulator. For remote, portable, sensor-transmitters which are part of a wireless system, this elimination of synchronous rectification becomes necessary unless, of course, the frequency and phase information can be transmitted from the pressure modulator to the remote sensor-transmitter by a wireless method such as a radio frequency signal. This, however, would make the wireless system more complex.

The aforementioned copending application Ser. No. 360,049 further disclosed the system as having a subsonic frequency of modulation low enough to substantially eliminate travelling wave interference phenomena, such as resonance and standing waves, resulting from reflection of pneumatic travelling waves by the walls of the enclosure.

In the case of a complex or other non-sinusoidal pressure variation induced by the pressure modulator, the term "frequency of modulation," or its equivalent, as used throughout this disclosure, generally refers to a frequency component or frequency band to which the sensing or monitoring means is tuned in order to monitor the deviation from the predetermined pressure variation. This frequency component or band generally is also the principal or characteristic frequency of the modulated pressure. In the case of a periodic pressure modulation, phrases such as "the frequency of modulation" generally refer to the fundamental frequency component of the pressure modulation which generally is also the principal or characteristic frequency. However, a modulaed pressure, whether periodic or not, may have more than one characteristic frequency and, in special situations, such as where sophisticated pattern recognition is required or desirable, the monitoring system may include means for monitoring or tuning to one or more of these characteristic frequencies, e.g., to the characteristic waveform of the pressure inducing means. In addition, since even a so-called "periodic" pressure modulator has some frequency drift, and since even a sharply tuned monitoring means has a finite frequency bandwidth the term "frequency", as used herein, generally refers in practice to a finite band of frequencies, or to the center frequency of such a band, wherein the band or center frequency may drift or otherwise change with time.

While the aforementioned copending application contemplates frequencies of modulation less than about 10.0 Hertz, and frequently greater than about 0.1 Hertz, for protecting from one up to a few ordinary sized rooms, it appears that if the monitoring means consists solely of the portable, battery operated, sensor-transmitters located in substantially closed chambers, such as in cabinets or chests-of-drawers, the above contemplated range of frequencies, in which the most feasible frequencies of induced pressure variation appear likely to occur, would be expected to shift somewhat towards higher frequencies, while likely still overlapping the above frequency range. This is partly because of the occurrence of a large increase in the amplitude of the pressure variation sensed by the sensor-transmitter when a drawer or other substantially closed chamber is opened to pressurization. This large signal or signal increase diminishes the required amplitude of induced pressure variation and/or the need to reduce drift and noise including spurious signals, and thus diminishes the need for synchronous rectification as well as diminishing the need to minimize standing waves and reverberation effects. Thus, a higher frequency might be used in spite of the resulting standing waves, and the sensor-transmitter can, at a higher frequency, be more easily tuned to the modulation frequency by means such as a bandpass filter. And, at the higher frequency and possibly lower amplitude of modulated pressure, a more conventional pressure modulator of the variable volume type, such as a coil-driven speaker diaphragm, becomes more feasible and might be used with such a system.

Such a monitoring system, wherein the sensors are portable and located in normally closed chambers, provides specific volume detection within an enclosure by protecting selected furniture or appliances of value as well as valuables located within chambers. For example, if a chamber formed by cooperation of a piece of furniture or appliance with the floor or wall of the enclosure is monitored by a pressure transducer, an alarm will be triggered when the furniture or appliance is moved away from the floor or wall. Thus, for example, a television console having a skirt extending to the floor could be protected by locating a portable sensor-transmitter under the chassis of the television set. For furniture having legs, a hole drilled or formed in a leg and extending from the bottom end of the leg, at the floor, to a monitored chamber within the furniture, would facilitate protection of such furniture via an alarm triggered when the furniture or object is lifted from the floor or when a door or drawer of the furniture is opened, thereby opening the chamber to pressurization, i.e., exposing the chamber to the modulated pressure created by the pressure variation inducing means. Alternatively, the sensor-transmitter itself could be located and shaped, e.g., cup-shaped or having a tube open at the end, to cooperate with the floor, wall, or other adjoining object to form a substantially closed chamber which is opened when the furniture or other item is moved. These are examples of detecting a change in impedance or volume of an enclosure or bounded region of an enclosure. Both the closed chamber and the outer chamber to which it is exposed are changed in impedance and volume by the movement or opening or exposure. (Generally, a change in the volume of an enclosure will change the impedance of the enclosure, since, for a given pressure modulator, the amplitude and/or phase of the modulated pressure is usually affected by the change in volume.) These are also examples of detecting a movement or change in the impedance of a boundary region or a portion of a boundary region of an enclosure, e.g., a boundary region which is moved or changed in impedance when the closed chamber is opened or exposed to the pressurized chamber.

Such a system consisting of portable (or even hard-wired) sensors located in substantially closed chambers would offer reasonably good volume protection (detection of an intruder within the volume of an enclosure) which is specific to certain items and also is flexible, since sensors can be moved to other chambers and furniture can be moved or interchanged. Such a system provides protection which is specific to certain items or locations and thus can permit certain desired use or maintenance of an enclosure, such as nighttime trips to the refrigerator of a home, movement of a pet in a home, or after-hours maintenance of a store or office building.

However, perimeter protection is provided by such a portable system only to the extent that there are enclosed chambers at or near the perimeter of the enclosure, such as double walls or double windows. On the other hand, volume and perimeter protection could be improved somewhat by adding a sensor within the pressurized volume of the enclosure and responsive to a decrease or other change in the modulated pressure even though such a sensor might not use synchronous rectification and even if the frequency of the pressure modulation is high enough to produce substantial pneumatic resonance or standing waves within the enclosure, i.e., even though its operational sensitivity to a change in impedance of the enclosure would be relatively low. Such a sensor in a pressurized region of the enclosure could also continually verify that there is a modulated pressure of sufficient amplitude in the enclosure for adequate protection capability of the sensor-transmitters located in the closed chambers of the enclosure.

In other words, although there are many trade-offs to consider in picking an optimum system and an optimum modulation frequency, which makes it difficult to predict optimum frequency, it appears that a monitoring system using portable sensor-transmitter units located mainly in normally closed chambers and not using synchronous rectification would tend to have a higher optimum modulation frequency, a volume detection capability which is more specific to certain objects or chambers within the enclosure, and poorer perimeter protection than a system monitoring mainly pressurized chambers and using synchronous rectification. On the other hand, a combination of these two basic types of systems can be used to obtain good overall protection.

It is, therefore, a primary object of this invention to provide an improved system for detecting entry into or egress from a substantially sealed enclosure, or for detecting opening or movement of a specified chamber located within an enclosure.

An additional object of this invention is to provide a new and improved system for detecting or monitoring changes in the fluidic impedance of an enclosure or of a closed chamber of an enclosure.

More particularly, it is an object of this invention to provide an improved system for detecting movement of certain specific objects within an enclosure, such as furniture or appliances or a sensor-transmitter unit, which are shaped and located so as to cooperate with a floor, wall, or other boundary region of the enclosure, to form a chamber which is at least substantially closed, wherein there is detected an appearance of or a change in a modulated pressure within or outside of the chamber or a modulated differential pressure across a boundary region of the chamber upon movement of the object.

Another object of this invention is to provide an improved, flexible, substantially wireless system for protecting an enclosure and/or specified objects or chambers within or adjoining the enclosure.

A further object of this invention is to provide an improved security system for protecting specific objects or chambers within or adjoining an enclosure while permitting certain maintenance or use of the enclosure.

Still another object is to provide an improved security system for an enclosure wherein inverse pressure variations are induced in two bounded regions of the enclosure by means of a motor driven reversible pitch or variable pitch fan.

Another object of this invention is to provide means for effecting a cyclical pressure variation within a bounded region of an enclosure by periodically varying the rate of air flow into, or reversing the direction of air flow into and out of, the bounded region, such means consisting of apparatus for changing the pitch of the blades of a fan used to conduct air into and/or out of the enclosure.

With the above and other objects in view that may hereinafter appear, the nature of the invention may be more clearly understood by reference to the several views illustrated in the attached drawings, the following detailed description thereof, and the appended claimed subject matter.

IN THE DRAWINGS

FIG. 1 is a schematic view of two rooms of an enclosure protected by the monitoring system of this invention, and illustrates a fan mounted in a wall separating the two rooms and adapted to cyclically modulate the pressures therein, apparatus for reversing the pitch of the fan blades, and means electrically connecting the pitch-changing apparatus to synchronous detection apparatus. Also disclosed in FIG. 1 is a piece of furniture located in one of the rooms and having an affixed, shaped, portable sensor-transmitter unit cooperating with a wall of the room to define a chamber which is substantially closed with respect to the room in which the pressure is being modulated; and a piece of furniture located in one of the rooms having means cooperating with a wall of the room to form a substantially closed chamber, and including a portable sensor-transmitter unit within the chamber;

FIG. 2 is a block diagram representative of one embodiment of a modulation, monitoring, and alarm system constructed in accordance with this invention, and illustrates a single pressure sensor and a pressure modulator electrically connected to a synchronous rectifier;

FIG. 3 is a block diagram representative of another embodiment of a modulation, monitoring, and alarm system constructed in accordance with this invention, and illustrates plural pressure sensors and a differential amplifier adapted to measure the difference in the signals transmitted by the plural sensors, as well as a pressure modulator connected to a synchronous rectifier;

Figure 5:
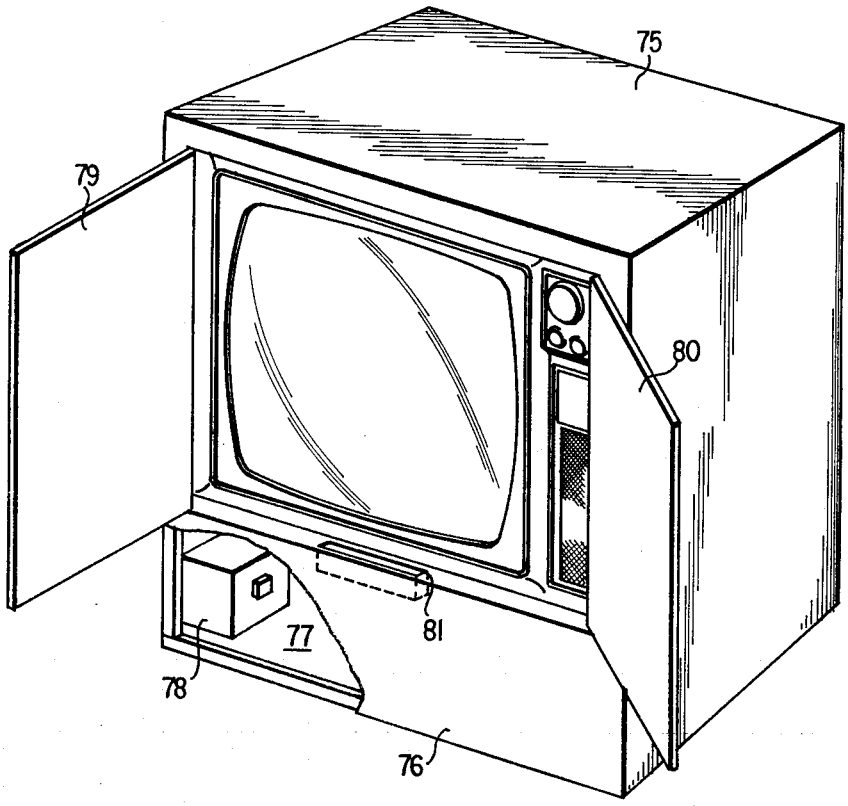
Figure 1:
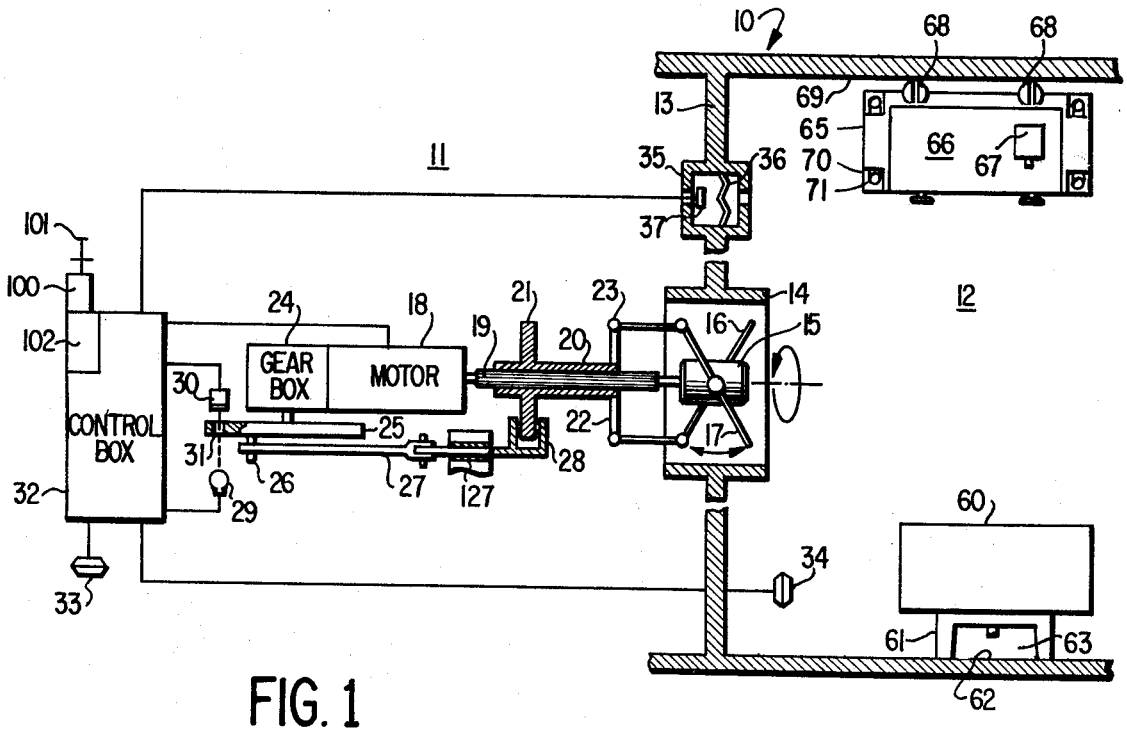

FIG. 4 is a block diagram representative of yet another embodiment of a modulation, monitoring, and alarm system constructed in accordance with this invention, and illustrates a portable pressure sensor, a pressure modulator not physically connected to the rectifier, and a wave shape discriminator or filter tuned to the approximate frequency of modulation; all but the pressure modulator may be combined into a single, portable, sensor-transmitter unit;

FIG. 5 is a perspective view of a television set having a downwardly depending skirt portion adapted to cooperate with the floor to define a chamber which is substantially closed with respect to the enclosure or room within which it is located, such as one of the rooms of FIG. 1, and a portable sensor-transmitter unit contained within the chamber;

FIG. 6 is an elevation view of a chest-of-drawers containing a portable sensor-transmitter unit, the chest having legs formed with an opening or bore extending from the floor into the interior of the chest, the legs adapted to cooperate with the floor to close the bore and thus the interior of the chest to define a chamber which is substantially closed with respect to the room in which it is located, such as one of the rooms in FIG. 1;

FIG. 7 is a fragmentary sectional view taken through a doorway of an enclosure, and illustrates means for oscillating the door to provide pressure modulations within the enclosure, as well as a phase wheel connected to the oscillating means and having a slot formed therein whereby a light bulb and a photocell may be utilized to monitor the frequency and phase of the oscillation;

FIG. 8 is a view taken along line 8 of FIG. 7, and illustrates the slotted phase wheel of the oscillating means.

Referring now to the drawings in detail, there is illustrated in FIG. 1 a fragmentary sectional view of a substantially closed structure or enclosure designated generally by the numeral 10. The enclosure 10 may be a building or structure containing one or more rooms or chambers, a unitary building such as a warehouse, a room or other subdivision within a building or structure, or any other type enclosure such as a vault, showcase, etc. As illustrated, the enclosure 10 includes two rooms 11, 12 separated by a wall 13. The wall 13 has an opening formed therein defined by a tubular conduit 14. A fan 15 having reversible pitch blades 16, 17 is mounted in the tubular conduit 14 and is adapted to cyclically and inversely vary the pressure in the two rooms 11, 12.

The fan 15 may be driven by a motor 18 through a splined shaft 19. A sleeve 20 having an annular flange 21 is adapted to slide axially on the splined shaft 19.

The sleeve 20 carries jointed arms 22, 23 which are connected to the fan blades 16, 17 respectively.

The motor 18 is connected to and geared down in RPM by gear box 24. The output of gear box 24 drives crank wheel 25 having an eccentrically disposed crank arm 26 extending therefrom. A jointed connecting rod 27 extends from the crank arm 26 and includes a yoke portion 28 which engages and drives annular flange 21 of the sleeve 20. A guide 127 for connecting rod 27 restricts yoke 28 to a pure reciprocating motion.

It should be apparent that as the fan 15 rotates at high RPM, the eccentrically disposed crank arm 26 rotating with the crank wheel or phase wheel 25 at low RPM will cause the connecting rod 27 to reciprocate at a lower frequency than the rotational frequency of fan 15, thereby causing the rotating sleeve 20 to oscillate axially on the splined shaft 19 which, in turn, effects a cyclical reversal of the pitch of fan blades 16, 17, at a rate of one complete pitch cycle for every revolution of the fly wheel 25. Consequently, the direction of air flow between the two rooms 11, 12 through conduit 14 is periodically reversed, thereby causing cyclical pressure variations within the two rooms which are approximately 180° out of phase with each other and which thus are inverse pressure variations. It should be understood that such a method of pressure modulation will maintain an average pressure equal to ambient pressure within each of rooms 11 and 12 of enclosure 10, and thus an oscillatory rather than uni-directional leakage flow of air through crevices and vents in the outside walls or boundary of enclosure 10, thereby reducing thermal transport through the external boundary regions of enclosure 10, relative to constant differential pressure systems of the prior art. This, in addition to the smaller required size of the fan and amplitude of the differential pressure, reduces heat loss from the enclosure in winter and heat gain in summer, relative to the prior art D.C. pressure systems.

The frequency and phase of pressure modulation may be monitored by any suitable means such as a light bulb 29 and photocell 30 which cooperate with an arcuate slot 31 formed in the phase wheel 25 by means of which the frequency of revolution and/or phase of the wheel 25 may be monitored and transmitted to a control box 32.

Conventional pressure sensors 33, 34 may be located in rooms 11, 12 and connected to the control box 32 for monitoring the modulated pressures within the rooms 11, 12. Alternatively, a single sensor may be used to monitor the difference in pressure between rooms 11, 12, such as differential pressure sensor 35 mounted in the wall 13 and having a flexible diaphragm 36 communicating with each of the two rooms 11, 12. Motion of the diaphragm 36 in response to the alternating differential pressure is sensed by proximity sensor 37. Or the diaphragm can be used as a flexible p;ate of a variable capacity capacitor, in order to detect the motion of the diaphragm. The diaphragm 36 thus forms a part of the boundary region separating bounded regions corresponding to rooms 11, 12. As illustrated schematically in FIG. 2, the output of differential pressure sensor 35 may be fed to a low-noise pre-amplifier 40 to increase the signal voltage. The output from the pre-amplifier 40 may be supplied via bandpass filter 41, which passes the modulated frequency but attenuates spurious signals at other frequencies, to a synchronous rectifier 42 where it is switched in polarity twice every cycle at the frequency of the pressure modulation in enclosure 10 and generally at the proper phase corresponding to maximum rectification of the amplified pressure modulated voltage. This is accomplished by transmitting a signal from the photocell 30 (which corresponds to the frequency of revolution and the phase of the wheel 25) to the synchronous rectifier 42 as reference voltage to drive the rectifier switches. This is represented in FIG. 2 by modulator 48 which supplies a reference voltage to synchronous rectifier 42. Modulator 48, which includes phase wheel 25, also is connected to and modulates pressurizer 15. A phase shifter, not shown, can be added between modulator 48 and rectifier 42 to adjust the switching phase as desired, e.g., for maximum amplitude rectified voltage. The representation of the signal after rectification is characterized as raw D.C. This signal is then fed to a smoother 43, which may be a low-pass filter such as an RC filter, where the signal is smoothed out so as to represent the average D.C. output proportional to the amplitude of the modulated pressure. One specific form of circuit arrangement suitable for perfoming the foregoing synchronous rectification and smoothing is shown in the aforementioned U.S. Pat. No. 2,451,572.

When the signal drops below a predetermined level, which would occur upon the amplitude of the pressure decreasing as a result of the enclosure 10 being opened, or other events occurring, an alarm 44 is actuated. For this purpose a comparator 45 having a comparison or bias circuit, with an adjustable bias level, and one or more threshold circuits 46 having adjustable levels, may be provided in alarm 44 to actuate the alarm. the comparison circuit, by means such as a differential amplifier, can be responsive to the difference between the adjustable bias level, which can be set to correspond to the predetermined pressure variation, and the output of smoother 43, which corresponds to the actual pressure variation. The output of the comparison circuit is then a measure of the deviation from the predetermined variation in differential pressure in enclosure 10 as sensed by pressure transducer 35 and at the selected phase. The output of the comparator 45 may be fed to one or more threshold circuits 46, any of which can produce an output to activate alarm 44 and transmit an alarm signal by means of a transmitter 47 in alarm 44. A threshold circuit is triggered to produce an output to actuate the alarm 44 and transmit an alarm signal when its input, and thus the deviation, is of the proper polarity and exceeds an adjustable threshold level. In this way, different thresholds may be selected for pressure variations below and above the predetermined pressure variation, e.g., below and above the bias level of the comparator 45.

Referring now to FIG. 3, there is illustrated an alternate embodiment of the invention wherein the signals from the plural sensors 33, 34 are fed through low-noise pre-amplifiers 40, 40′ and bandpass filters 41, 41′ to a differential amplifier 50 which performs a subtraction operation and transmits the instantaneous algebraic difference between the two signals continuously to the synchronous rectifier 42. As in FIG. 2, modulator 48 modulates pressurizer 15 and provides phase information to synchronous rectifier 42. The rectified signal is then fed through the smoother 43 to the alarm 44 comprising comparator 45, threshold circuits 46, and transmitter 47, wherein the smoothed signal is processed in a manner similar to that discussed above with reference to FIG. 2. However, pre-amplifiers 40, 40′ can have different gains, either inherently or by virtue of gain adjuster 49 which can adjust the gain of either pre-amplifier and thus their relative gains. This can be useful, for example, for more completely cancelling, by the subtraction process in differential amplifier 50, a spurious effect such as wind which is common to rooms 11, 12 but which may be stronger or differ slightly in phase in one of rooms 11, 12 than in the other by virtue, for example, of their differing volumes or pneumatic impedances or time constants with respect to the spurious pneumatic source. For this and other reasons, the relative or absolute gains of amplifiers 40, 40' and thus the effective relative or absolute sensitivities of pressure sensors 33, 34 can be adjusted to improve detection sensitivity while reducing the false alarm rate or probability. Any linear combination of the two signals can be obtained by this comparison process which is only one example of how pressures or pressure variations may be compared. If the spurious effects in the rooms monitored by sensors 33, 34 are severe and sufficiently out of phase with each other, a phase shifter or other time delay device (not shown) can be used to delay the modulated signal in one of channels 33, 34 relative to the other channel before the channels are subtracted. For example, each channel could be synchronously rectified separately, with one or two phase shifters to vary the relative phases of the synchronous rectifications, and the rectified signals then subtracted by means of the differential amplifier (instead of before the rectification). In this way the spurious effects might be cancelled out more completely without severely degrading the differential pressure signal. Alternatively, instead of subtracting the outputs of sensors 33, 34, other methods of comparison may be used, such as ratio of phase difference.

Referring now to FIG. 4, there is illustrated yet another embodiment of this invention which relates to a "wireless" detection system comprising a pressurizer 15 and a modulator 48 and a remote portable sensor-transmitter unit. The signal from the pressure sensor 55 is transmitted through the low-noise pre-amplifier 40 to a waveshape discriminator or filter 57 which is tuned to the approximate frequency or frequencies of modulation. The resulting signal is then rectified by non-synchronous rectifier 56 and fed through the smoother 43 to the alarm 44 in the same manner as discussed above with reference to FIGS. 2 and 3. Modulator 48 is not physically connected to rectifier 56. The portable sensor-transmitter can include components 55, 40, 57, 56, 43, 45, 46 and 47 and can be located most anywhere with an enclosure. If located in a closed chamber, however, such as in a piece of furniture, comparator 45 of alarm 44 would be omitted and smoother 43 connected directly to one or more threshold circuits 46.

Referring again to FIG. 1, there is illustrated in room 12 a piece of furniture 60 which is intended to be protected by the monitoring system of this invention, or which is used to detect the presence of an intruder within room 12 or enclosure 10. The furniture 60 is so formed to define, or otherwise has attached thereto, a "shaped" sensor-transmitter unit 61 that is adapted to cooperate with a wall 62 of the enclosure 10 to define a chamber 63 that is at least substantially closed with respect to the room 12 in which the pressure is being modulated. The sensor portion of the sensor-transmitter unit 61 communicates with the interior of the chamber 63 such that if the furniture 60 is moved away from the wall 62, the interior of the chamber 63 will be opened to the pressure in the room 12 and the alarm 44 thereby actuated by the sudden appearance of or increase in the modulated pressure. Because of typical leakage, chamber 63 generally is not completely closed and thus there generally is a low amplitude modulated pressure in chamber 63 even when the piece of furniture 60 is pushed against wall 62.

Also illustrated in FIG. 1 is a chest-of-drawers 65 having a chamber 66 comprising the unfilled volume in and around the drawers, which chamber is substantially closed with respect to the room 12, and having a portable sensor-transmitter 67 contained therein. The chest 65 includes rubber grommets 68, or the like, which are mounted in holes in the backside of chest 65 and adapted to abut against a wall 69 of the enclosure 10. The grommets 68 have axial openings formed therethrough which are adapted to communicate with the interior of the chamber 66. However, when the grommets 68 abut against the wall 69, and all of the drawers of the chest 65 are closed, the chamber 66 is substantially closed with respect to the room 12. It should be apparent, therefore, that the grommets 68 are "shaped" to cooperate with the wall 69 in essentially the same manner that the sensor-transmitter unit 61 cooperates with the wall 62 to define the substantially closed chamber. When the chest 65 is moved away from the wall 69, or when any drawer of chest-of-drawers 65 is opened, the sensor-transmitter unit 67 will actuate the alarm 44 as a result of the presence of a large amplitude modulated pressure in chamber 66.

As seen most clearly in FIG. 6, the chest 65 also includes legs 70 having vertical bores 71 formed therein which turn horizontally within the body of chest 65 to communicate with the chamber 66. When the chest 65 is resting on the floor 72 of the room 12, and if the grommets 68 are against the wall 69 and the drawers closed, the chamber 66 will be substantially closed with respect to the room 12. However, if the chest 65 is lifted from the floor 72, the modulated pressure in the room 12 will be communicated through the bores 71 to the interior of the chamber 66 and the sensor-transmitter unit 67 will thereby actuate the alarm 44 which generally would be within unit 67.

Referring now to FIG. 5, there is illustrated a televison set 75 having a depending skirt portion 76 which cooperates with the surface upon which it is resting to define a chamber 77 that is substantially closed with respect to the room in which it is located, e.g., the pressurized room 12. A portable sensor-transmitter unit 78 is contained within the chamber 77 and will operate to actuate the alarm 44 if the television set 75 is lifted from the surface upon which it is resting to communicate the chamber 77 with the pressurized room in which it is located. The television set 75 may also include doors 79, 80 which, when closed, define a closed chamber in front of the television screen. This chamber may communicate with the chamber 77 through a suitable opening 81 formed in the frame of the set. Consequently, if either of the doors 79, 80 are opened, the pressure in the room in which the television set 75 is located will be communicated through the opening 81 to the chamber 77, thereby being sensed by the sensor-transmitter unit 78 and thus actuating the alarm 44.

Turning now to FIG. 7, there is illustrated alternate means for causing inverse cyclical pressure variations on opposite sides of the wall 13. A door 90 hinged in the wall 13 is adapted to be oscillated by means of a motor 91 geared down by gear box 92, the output shaft of which drives crank wheel 93 and crank 94, the latter of which is connected to and drives the door via connecting rod 95. Reciprocation of the connecting rod 95 will cause oscillation of the door 90 and corresponding pressure variations on either side of the wall 13. Sealing strips 99 may be provided along the side and top of the door 90 to reduce leakage.

The crank wheel or phase wheel 94 may include an arcuate slot 96 (see also FIG. 8) through which a beam of light from a bulb 97 may pass to a photocell 98 during a portion of each revolution of the phase wheel 94, thereby generating a signal corresponding to the modulation frequency and phase for transmission to the control box 32 (of FIG. 1) for providing synchronous rectification of the pressure monitored by one or more sensors such as sensors 35, 33, and 34 of FIG. 1.

It should be understood that the mechanism for oscillating door 90 could be located beyond an edge of the door so that the door could be opened at any time without damaging the mechanism. Slip joints, spring joints, and/or a friction slip drive can be used to allow opening of the door when forced and for limiting the maximum drive force on the door, for purposes of safety and convenience.

Referring once again to FIG. 1, there is illustrated a receiver 100 having an antenna 101 which may receive signals from any of the sensor-transmitter units as hereinbefore described. An alarm or other signal received by the receiver 100 is transmitted to a data relay station 102 where it may be fed either directly into the control box 32 for processing or to a local or remote audible alarm generator or other type of alarm indicator, in order to alert a resident, guard, or police and/or to record the alarm, voltage or other information. It should be understood, of course, that while the receiver 100 and data relay station 102 are illustrated in FIG. 1 as being proximate to the control box 32, they may, in fact, be located remote therefrom.

Referring once more to FIG. 1, it should be understood that if the differential pressure across the boundary region or wall 13 is monitored by means of either the plural sensors 33, 34, or the differential pressure sensor 35, the effects of external wind on bounded regions or rooms 11, 12 tend to cancel out when the output of sensors 33, 34 are subtracted in the control box 32, or when subtracted inherently in the differential pressure sensor 35 which includes the diaphragm 36. To maximize the cancelling, the pneumatic time constants of rooms 11 and 12 should be equal. Thus, if their volumes are equal so should their boundary impedances or leakages to the outside be substantially equal. If their volumes differ by a given ratio, so should their boundary impedances or leakages to the outside differ by approximately the same ratio if their pneumatic time constants relating to wind effects are to be approximately equal. This would tend to equalize the normally very slight wind effects in the two rooms, whereby the wind effects would be cancelled by the subtraction process, to allow greater detection sensitivity without false alarms.

Since wind is directional and since rooms 11 and 12 have different exposures, the cancelling process will be less effective for some wind directions than for others. If rooms 11 and 12 have vents, such as for fresh air, exhaust, heating, or air conditioning, it is therefore generally preferable not only that the fluidic impedances or conductances of the vents be designed or adjusted for similar time constants and susceptibility of the two rooms to effects from spurious sources such as wind, heaters, or air conditioners that may have significant frequency components at or near the modulation frequency, but further that the vents or ducts combine with each other and/or lead to the outside at the same or proximate locations on the structure or enclosure 10, whereby the effects of wind direction become relatively insignificant.

In essence, each of rooms 11, 12 is acting as a reference chamber for estimating the wind effects in the other room and correcting the modulated pressure reading in the other room for the estimated wind effects, so as to correct for, or cancel out, the wind effects. Such a reference chamber maay be useful in other similar ways or for other system configurations also. For example, if a pressure modulator is used which modulates the pressure in essentially only a single bounded region of an enclosure (in contrast with the two bounded regions described above), e.g., by means of a thermally driven closed bellows, wind effects can similarly be compensated for by using as a reference chamber a room or chamber which is substantially closed off from the pressure modulator but which experiences spurious effects such as wind in a manner similar to the pressurized chamber. By monitoring pressure in the pressure modulated chamber and in the reference chamber, and properly comparing the pressures, the wind and/or other spurious effects in the modulated chamber can be, to a significant degree, corrected for and cancelled out. Thus, for example, the differential pressure between the pressure-modulated bounded room and the non-pressure-modulated bounded reference room or chamber can be monitored to cancel wind effects. Or, the pressure variations in the two chambers can be monitored separately and then compared, i.e., combined in some manner, to reduce spurious effects such as wind.

This general method of comparison of pressures in two or more rooms or chambers to correct for spurious effects such as wind or even for drifts in the pressure modulator or other system components, is useful to the extent that the spurious effects are, or can be made, equal, similar, or at least correlated in some manner in the two or more rooms or chambers. For example, matching the pneumatic time constants of two chambers with regard to a spurious pressure source such as wind tends to equalize the spurious pressure fluctuations in the two chambers so that a comparison technique such as monitoring the differential pressure can be used to cancel out the effects on the system output of the spurious fluctuations.

Although only specific embodiments of the invention have been illustrated and described herein, it is to be understood that minor modifications can be made therein without departing from the spirit of the invention.

For example, the reversible pitch fan 15 in FIG. 1 can be modified to serve simultaneously as a conventional, continuous differential pressure fan and as a modulated differential pressure fan by shortening or lengthening jointed arms 22, 23 which are connected to fan blades 16, 17. The resulting variable pitch fan would then induce a positive average pressure in one of rooms 11, 12 and a negative average pressure, i.e., a partial vacuum, in the other of rooms 11, 12 while simultaneously inducing inverse pressure variations in the two rooms. Although heat exchange between the enclosure 10 and the external environment tends to be greater with such a combination fan, continuous ventilation of an enclosure is sometimes desirable for purposes of forced fresh air, forced air heating, or air conditioning. Thus, in the above or an equivalent manner, an existing exhaust or ventilation fan, heating fan, or air conditioning fan in a building or other enclosure can be modified to produce a modulated pressure or modulated differential pressure in the enclosure for the purposes of this invention, while simultaneously serving its basic function of inducing a net flow of air in one direction through the fan and a positive or negative average pressure in the enclosure or in one or more bounded regions thereof.

I claim:

1. In an enclosure having at least one boundary region defining at least one bounded region, a monitoring system for detecting movement of, or substantial opening of, an object within said enclosure and forming at least a portion of said boundary region, such as furniture, appliances, closets or the like; comprising:

means for inducing a predetermined variation in pressure with respect to time within at least one bounded region of said enclosure;

means including a portion of said boundary region defining a chamber which is normally substantially closed off from communication with said bounded region, said chamber being defined at least in part by said object; and pressure sensing means operatively located in said chamber;

wherein the movement or opening of the object causes a substantial opening of said chamber such that communication of said chamber with the bounded region is substantially increased, the increased communication causing a substantial increase in penetration of the pressure variation into said chamber, whereby said pressure sensing means senses the increased penetration of the induced pressure variation into said chamber thereby detecting the movement or opening of said object.

2. The monitoring system of claim 1 wherein said pressure sensing means is responsive to the appearance of said induced pressure variation in said chamber.

3. The monitoring system of claim 1 wherein said pressure sensing means is responsive to an increase in amplitude of said induced pressure variation in said chamber.

4. The monitoring system of claim 1 wherein said object is constructed to cooperate with at least a portion of said at least one boundary region to define said normally substantially closed chamber, whereby relative movement of said object and said boundary region portion with respect to each other can cause said increased communication and penetration thereby permitting said pressure sensing means to detect said relative movement.

5. The monitoring system of claim 4 wherein said object includes a housing containing an internal cavity, said chamber being primarily defined by said cavity, said housing including conduit means for establishing communication between said cavity and said boundary region portion for facilitating said cooperation.

6. The monitoring system of claim 1 wherein said object includes a portable sensor-transmitter unit for monitoring pressure and for generating and transmitting a pressure-indicating signal, said unit being affixed to a portion of said object and shaped to cooperate with at least a portion of said at least one boundary region in abutting relationship therewith to define said normally substantially closed chamber, said pressure sensing means forming part of said unit and operatively extending into said chamber, whereby movement of said object away from said boundary region portion will open said chamber to communicate with said at least one bounded region and will be detected by said pressure sensing means.

7. The monitoring system of claim 1 wherein said inducing means includes means for varying the pressure at a substantially constant amplitude and frequency.

8. The monitoring system of claim 1 wherein said inducing means includes a fan for producing a flow of fluid in said bounded region.

9. The monitoring system of claim 1 wherein said inducing means includes a variable pitch fan for producing a flow of fluid in said bounded region and modulating said flow.

10. The monitoring system of claim 1 wherein said inducing means includes an oscillating door for producing a flow of fluid in said bounded region and modulating said flow.

11. The monitoring system of claim 1 including means for tuning the sensing means to the induced variation in pressure in said at least one bounded region.

12. The monitoring system of claim 11 wherein the principal frequency of the induced pressure variation is greater than about 0.1 Hertz and less than about 10.0 Hertz.

13. The monitoring system of claim 1 wherein the induced pressure variation has a characteristic frequency which is less than about 10.0 Hertz.

14. The monitoring system of claim 1 wherein the sensing means includes synchronous detection means for producing a signal indicative of the amplitude of the induced pressure variation.

15. The monitoring system of claim 1 wherein the inducing means includes means for inducing substantially inverse pressure variations in said at least one bounded region and in another bounded region of the enclosure.

16. The monitoring system of claim 1 wherein the sensing means forms part of a portable sensor-transmitter unit responsive to pressure variations in said chamber and designed to generate and transmit an indicating signal upon substantial opening of said chamber.

17. The monitoring system of claim 16 including means for tuning the portable sensor-transmitter unit to the induced pressure variation in said at least one bounded region.

18. The monitoring system of claim 16 wherein the induced pressure variation has a characteristic frequency which is greater than about 0.1 Hertz and less than about 10.0 Hertz.

19. The monitoring system of claim 16 wherein the sensor-transmitter unit includes a battery operated power source.

20. The monitoring system of claim 1 wherein the sensing means is portable and includes a battery operated power source.

21. The monitoring system of claim 1 wherein said inducing means includes means for inducing a predetermined substantially uniform variation in pressure within said at least one bounded region of said enclosure.

22. The monitoring system of claim 21 wherein said pressure sensing means is responsive to the appearance of said induced pressure variation in said chamber.

23. The monitoring system of claim 21 wherein said pressure sensing means is responsive to an increase in amplitude of said induced pressure variation in said chamber.

24. The monitoring system of claim 21 wherein said object is constructed to cooperate with at least a portion of said at least one boundary region to define said normally substantially closed chamber, whereby relative movement of said object and said boundary region portion with respect to each other can cause said increased communication and penetration thereby permitting said pressure sensing means to detect said relative movement.

25. The monitoring system of claim 24 wherein said object includes a housing substantially defining said chamber, and conduit means extending from said chamber and adapted to abut against said boundary region portion to substantially close said chamber.

26. The monitoring system of claim 21 wherein said object includes a portable sensor-transmitter unit for monitoring pressure and for generating and transmitting a pressure-indicating signal, said unit being affixed to a portion of said object and shaped to cooperate with at least a portion of said at least one boundary region in abutting relationship therewith to define said normally substantially closed chamber, said pressure sensing means forming part of said unit and operatively extending into said chamber, whereby movement of said object away from said boundary region portion will open said chamber to communicate with said at least one bounded region and will be detected by said pressure sensing means.

27. The monitoring system of claim 21 wherein said inducing means includes means for varying the pressure at a substantially constant amplitude and frequency.

28. The monitoring system of claim 21 wherein said inducing means includes a fan for producing a flow of fluid in said bounded region.

29. The monitoring system off claim 21 wherein said inducing means includes a variable pitch fan for producing a flow of fluid in said bounded region and modulating said flow.

30. The monitoring system of claim 21 including means for tuning the sensing means to the induced variation in pressure in said at least one bounded region.

31. The monitoring system of claim 30 wherein the principal frequency of the induced pressure variation is greater than about 0.1 Hertz and less than about 10.0 Hertz.

32. The monitoring system of claim 21 wherein the sensing means includes synchronous detection means for producing a signal indicative of the amplitude of the induced pressure variation.

33. The monitoring system of claim 21 wherein the sensing means includes a portable sensor-transmitter unit responsive to pressure variations in said chamber and designed to generate and transmit an indicating signal upon substantial opening of said chamber.

34. The monitoring system of claim 33 including means for tuning the portable sensor-transmitter unit to the induced pressure variation in said at least one bounded region.

35. The monitoring system of claim 21 wherein the inducing means includes means for inducing substantially inverse pressure variations in said at least one bounded region and in another bounded region of the enclosure.

36. The monitoring system of claim 21 wherein the sensing means is portable and includes a battery operated power source.

37. The monitoring system of claim 1 wherein said pressure sensing means further includes a sensor in said bounded region, said pressure sensing means including means for comparing the pressures in said chamber and said bounded region.

38. The monitoring system of claim 1 wherein said pressure sensing means further includes a sensor external to said chamber, said pressure sensing means including means for comparing the pressure measured in said chamber with the pressure measured by said sensor, said pressure comparison tending to reduce spurious pressure effects.

39. The monitoring system of claim 38 wherein the induced pressure variation has a characteristic frequency, and including means for tuning said pressure sensing means to the characteristic frequency.

40. A portable sensor-transmitter unit adapted to be affixed to an object to be protected against unauthorized movement or removal, such as furniture, appliances or the like, said unit being shaped to define a substantially closed chamber when abutted in cooperative relationship with a boundary region of an enclosure in which pressure may be varied with respect to time, said unit including sensing means operatively connected with said chamber for monitoring the varied pressure in said chamber and for generating and transmitting a pressure-indicating signal upon substantial increase in amplitude of the varied pressure in said chamber resulting from movement of said unit away from a boundary region against which it is abutted.

41. The sensor-transmitter unit of claim 40 wherein said unit includes a battery operated power source.

42. The sensor-transmitter unit of claim 40 wherein said sensing means includes means for tuning to the variation in pressure in an enclosure.

43. A monitoring system for detecting a change in the fluidic impedance of an enclosure comprising means including a variable pitch fan for inducing a predetermined substantially uniform variation in pressure with respect to time within at least one bounded region of said enclosure, and sensing means for monitoring deviation from said predetermined variation.

44. The monitoring system of claim 43 wherein the pressure variation has a characteristic amplitude and a characteristic frequency less than about 10.0 Hertz.

45. The monitoring system of claim 43 wherein said fan produces substantially inverse pressure variations in two bounded regions of said enclosure, and wherein said sensing means includes means for comparing said pressure variations in said two bounded regions.

46. The monitoring system of claims 45 wherein the comparison means includes means for monitoring the difference between the pressures in the two bounded regions.

47. The monitoring system of claim 45 wherein the comparison means includes means for obtaining a linear combination of the pressure variations in the two bounded regions.

48. The monitoring system of claim 43 wherein the monitoring means includes synchronous detection means for producing a signal indicative of the amplitude of the induced pressure variation.

49. The monitoring system of claim 43 wherein the pressure variation is of substantially constant amplitude and frequency.

50. The monitoring system of claim 49 wherein the monitoring means includes synchronous rectification and filtering means for producing a signal indicative of the amplitude of the induced pressure variation.

51. A monitoring system for detecting a change in the fluidic impedance of an enclosure comprising means including a motor driven door for inducing a predetermined substantially uniform variation in pressure with respect to time within at least one bounded region of said enclosure, and sensing means for monitoring deviation from said predetermined variation.

52. The monitoring system of claim 51 wherein said door produces substantially inverse pressure variations in two bounded regions of said enclosure, and wherein said monitoring means includes means for comparing said inverse pressure variations.

53. The monitoring system of claim 52 wherein said comparison means includes monitoring of the difference in pressure in the two bounded regions.

54. The monitoring system of claim 52 wherein the monitoring means includes synchronous rectification means for producing a signal indicative of the amplitude of the induced pressure variation.

* * * * *